US007265605B1

(12) United States Patent
Vasudevan

(10) Patent No.: US 7,265,605 B1
(45) Date of Patent: Sep. 4, 2007

(54) SUPPLY REGULATOR FOR MEMORY CELLS WITH SUSPEND MODE CAPABILITY FOR LOW POWER APPLICATIONS

(75) Inventor: Narasimhan Vasudevan, Los Angeles, CA (US)

(73) Assignee: Xilinx, Inc., San Jose, CA (US)

( * ) Notice: Subject to any disclaimer, the term of this patent is extended or adjusted under 35 U.S.C. 154(b) by 189 days.

(21) Appl. No.: 11/252,504

(22) Filed: Oct. 18, 2005

(51) Int. Cl.
*G05F 1/10* (2006.01)

(52) U.S. Cl. ..... 327/534

(58) Field of Classification Search ..... 327/407, 327/408, 530, 534, 535, 537, 538, 541
See application file for complete search history.

(56) References Cited

U.S. PATENT DOCUMENTS 5,786,724 A * 7/1998 Teggatz ..... 327/534
7,046,074 B2 * 5/2006 Jang ..... 327/534
7,215,043 B2 * 5/2007 Tsai et al. ..... 307/130

* cited by examiner

*Primary Examiner*—Jeffrey Zweizig
(74) *Attorney, Agent, or Firm*—William L. Paradice, III; Lois D. Cartier

(57) ABSTRACT

An integrated circuit (IC) device includes a first voltage supply for powering first circuitry within the device, a second voltage supply for powering second circuitry within the device, a suspend circuit having an output to generate a power-down signal, and a voltage regulator circuit coupled to a power node. The voltage regulator circuit includes a first transistor coupled between the first voltage supply and the power node and having a gate responsive to a regulation signal, a second transistor coupled between the second voltage supply and the power node and having a gate responsive to the power-down signal, and a well bias circuit having an input coupled to receive the power-down signal, a first output coupled to a well region of the first transistor, and a second output coupled to a well region of the second transistor.

20 Claims, 6 Drawing Sheets

SUPPLY REGULATOR FOR MEMORY CELLS WITH SUSPEND MODE CAPABILITY FOR LOW POWER APPLICATIONS

FIELD OF INVENTION

The present invention relates generally to integrated circuits, and more specifically to allowing an integrated circuit device to be placed in a power-saving mode while retaining data stored in volatile memory elements provided therein.

DESCRIPTION OF RELATED ART

A configurable integrated circuit (IC) is an integrated circuit including various configurable resources. A programmable logic device (PLD) is a well-known type of configurable IC that can be programmed by a user to implement a variety of selected functions. PLDs are becoming increasingly popular with circuit designers because they require less time to design than custom-designed integrated circuits such as Application Specific Integrated Circuits (ASICs).

There are many types of PLDs such as Field Programmable Gate Arrays (FPGAs) and complex PLDs (CPLDs). For example, an FPGA typically includes a plurality of configurable logic blocks (CLBs), a plurality of input/output blocks (IOBs), and a number of block RAM elements selectively connected to each other to implement complex user designs by a programmable interconnect structure. The CLBs are individually programmable and can be configured to perform a variety of logic functions. The IOBs are selectively connected to various I/O pins of the FPGA, and can be configured as either input buffers or output buffers. The block RAM elements can store data during operation of the FPGA and/or can be configured to implement various functions such as FIFO memories and state machines. The various functions and signal interconnections implemented by the CLBs, IOBs, and the programmable interconnect structure are controlled by a number of corresponding configuration memory cells that store configuration data that embodies a desired user design. Typically, the configuration memory cells are volatile memory cells such as SRAM cells that do not retain data when power is removed. An FPGA may include other types of configurable resources, such as multipliers, processors, transceivers, DSP blocks, clock managers, etc.

For many FPGA devices, the core logic (e.g., the CLBs) is powered by a main voltage supply (VDD), while the I/O circuitry and configuration memory cells are powered by a separate auxiliary voltage supply (VCCAUX), where VCCAUX is typically greater than VDD. For example, FIG. 1A shows a simplified portion 100A of an exemplary IC device such as an FPGA that includes a VCCAUX voltage regulator circuit 110A, a VDD voltage regulator circuit 120A, a power-on reset (POR) circuit 130, a plurality of volatile memory cells 140, I/O circuitry 150, and core logic 160. Voltage regulator 110A, which includes a PMOS transistor 111 and an op-amp 113, generates a regulated voltage Vgg at a power node A for powering memory cells 140. PMOS transistor 111 is coupled between VCCAUX and node A, and has a well region tied to VCCAUX. Op-amp 113, which is well-known, includes a first input terminal coupled to a reference voltage Vref, a second input terminal coupled to node A, and an output terminal coupled to the gate of PMOS transistor 111. Vref may be generated using any well-known technique, for example, using a ratioed bandgap reference voltage circuit. Voltage regulator 120A includes a PMOS transistor 121 coupled between VDD and node A, and has a well region tied to VDD. The gate of transistor 121 receives a power-on signal POR from POR circuit 130.

POR circuit 130, which is well-known, informs device 100A when to start configuration and/or to reset its registers. I/O circuitry 150, which may provide well-known input/output connections for device 100A, has a power terminal coupled to VCCAUX. Core logic 160, which may include any well-known logic elements such as the CLBs of an FPGA device, has a power terminal coupled to VDD. For purposes of discussion herein, VDD is equal to approximately 1.2 volts, VCCAUX is equal to approximately 2.5 volts, and Vgg is regulated to approximately 1.35-1.4 volts. Further, as known in the art, PMOS transistors 111 and 121 are power transistors having relatively large channel widths and relatively thick gate oxides, and therefore occupy significantly more silicon area than transistors (not shown for simplicity) that form memory cells 140 and core logic 160.

Upon power-up of device 100A, POR circuit 130 deasserts POR to logic low, which turns on PMOS transistor 121. The conductive state of PMOS transistor 121 allows current to flow from VDD to node A, thereby quickly charging Vgg towards VDD during device power-up. When VDD has reached an acceptable level (e.g., suitable for initializing core logic 160 and other circuitry powered by VDD to operational states), POR circuit 130 asserts POR to logic high, which turns off PMOS transistor 121 to isolate Vgg from VDD. During the power-up sequence, op-amp 113 is typically disabled to prevent current flow between VCCAUX and VDD through transistor 111. After the power-up sequence is complete, op-amp 113 becomes operational and regulates Vgg using VCCAUX in a well-known manner by adjusting the gate voltage of PMOS transistor 111 until Vgg is equal to Vref.

Unfortunately, undesirable fluctuations in the values of Vgg and/or VDD may degrade performance of device 100A if Vgg sufficiently exceeds VDD. For example, if Vgg rises above 1.4 volts (e.g., resulting from fluctuations in the voltage regulation circuitry) while VDD falls to 0.8 volts, the diode formed by the well/source junction of PMOS transistor 121 may become forward biased and inadvertently create a current path from VCCAUX to VDD through transistors 111 and 121, which may significantly increase the power dissipation of device 100A.

One solution to prevent this undesirable current path from VCCAUX to VDD through transistor 121 is to provide isolation transistors in regulators 110A and 120A. For example, referring to FIG. 1B, device 100B includes a VCCCAUX voltage regulator circuit 110B having two PMOS transistors 111-112 coupled in series between VCCAUX and node A, and includes a VDD voltage regulator circuit 120B having two PMOS transistors 121-122 coupled in series between VDD and node A. The gates of transistors 121-122 receive a power-on signal POR2, and the gate of transistor 112 receives POR2_*b* (e.g., the logical complement of POR2). The well of transistor 111 is tied to VCCAUX, the well of transistor 121 is tied to VDD, and the wells of transistors 112 and 122 are tied to Vgg. The peak voltage of POR2 is typically set to Vgg.

As known in the art, the well connections of transistors 111-112 and 121-122 depicted in FIG. 1B prevent the forward-biasing of diodes within transistors 111-112 and 121-122 when Vgg exceeds VDD, thereby alleviating the aforementioned disadvantages of device 100A of FIG. 1A. However, because the inclusion of transistors 112 and 122 effectively doubles the series resistance of the current path between VCCAUX and node A and the current path between VDD and node A, respectively, the channel widths of PMOS transistors 111-112 and 121-122 of FIG. 1 need to be approximately twice that of transistors 111 and 121 of FIG. 1A to maintain similar drive strengths for Vgg. As a result, power transistors 111-112 and 121-122 of device 100B occupy approximately four times as much silicon area as power transistors 111 and 121 of device 100A.

Further, during periods when device 100B is idle (e.g., not communicating with other devices), it may be desirable to temporarily power-down I/O circuitry 150 by disabling or reducing the value of VCCAUX while maintaining the VDD power supply to core logic 160, thereby reducing power consumption of the device by minimizing power dissipation in I/O circuitry 150. However, because volatile memory cells 140 are powered by a regulated voltage Vgg that is normally generated from VCCAUX, disabling VCCAUX to minimize power dissipation in I/O circuitry 150 typically reduces Vgg to a level that is insufficient for memory cells 140 to retain data stored therein. For example, if device 100B is an FPGA device and memory cells 140 are configuration memory cells that store configuration data (e.g., for configuring programmable elements with I/O circuitry 150 and/or core logic 160), temporarily disabling VCCAUX to minimize power dissipation in I/O circuitry 150 typically results in the loss of configuration data stored in memory cells 140, and therefore subsequent operation of the device requires the memory cells 140 to be re-loaded with the configuration data during a subsequent re-configuration operation, which is an inconvenient and time consuming process.

Thus, it would be desirable to not only reduce the circuit area of prior voltage regulator circuits but also to allow VCCAUX to be temporarily disabled to reduce power consumption without losing data stored in volatile memory cells powered by a regulated voltage generated from VCCAUX.

SUMMARY

An apparatus is disclosed that allows some circuitry such as volatile memory cells that is normally powered by an auxiliary voltage supply to be powered by a main voltage supply during a suspend mode when the auxiliary voltage supply is disabled to reduce power consumption in other circuitry powered by the auxiliary voltage supply, thereby preserving data stored in the volatile memory cells during the suspend mode. In accordance with the present invention, an integrated circuit (IC) device includes a first voltage supply for powering first circuitry within the device, a second voltage supply for powering second circuitry within the device, wherein the second voltage supply is less than the first voltage supply, a suspend circuit having an output to generate a power-down signal, and a voltage regulator circuit coupled to a power node.

For some embodiments, the voltage regulator circuit includes a first transistor coupled between the first voltage supply and the power node and having a gate responsive to a regulation signal, a second transistor coupled between the second voltage supply and the power node and having a gate responsive to the power-down signal, and a well bias circuit having an input coupled to receive the power-down signal, a first output coupled to a well region of the first transistor, and a second output coupled to a well region of the second transistor. The well bias circuit selectively adjusts a first bias voltage provided to the well of the first transistor, and selectively adjusts a second bias voltage provided to the well of the second transistor to prevent the well/source junction diodes within the first and second transistors from becoming forward biased.

During a normal mode of operation, the power-down signal is de-asserted, which allows the first transistor to generate a regulated voltage at the power node from the first voltage supply, for example, to power volatile memory cells coupled to the power node. The de-asserted power-down signal turns off the second transistor to isolate the second voltage supply from the power node, and causes the well bias circuit to couple the well of the second transistor to the power node. During a suspend mode of operation, the power-down signal is asserted, which disables the first voltage supply to reduce power consumption of circuitry powered by the first voltage supply. The asserted power-down signal also turns on the second transistor to couple the second voltage supply to the power node, and causes the well bias circuit to couple the well of the second transistor to the second voltage supply. During the suspend mode, the second voltage supply generates at the power node a voltage sufficient to retain data stored in volatile memory cells having a power terminal coupled to the power node.

For other embodiments, the voltage regulation circuit may further include a plurality of third transistors, each coupled in parallel between the second voltage supply and the power node and each having a gate to receive a corresponding enable signal. During suspend mode, a magnitude of a voltage produced at the power node may be adjusted by selectively asserting one or more of the enable signals to turn on one or more corresponding third transistors. For some embodiments, the enable signals may be stored in storage elements. For other embodiments, the enable signals may be hardwired to desired logic states.

BRIEF DESCRIPTION OF THE DRAWINGS

The features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION

The present invention is applicable to a variety of integrated circuits and systems, and is particularly useful for devices having volatile memory cells that are initialized by a main voltage supply upon device power-on and subsequently powered by an auxiliary voltage supply during normal operation and having a suspend feature that temporarily disables the auxiliary voltage supply to reduce power consumption, for example, when the device is not communicating with other devices. Thus, embodiments of the present invention may be especially applicable for temporarily powering-down the I/O circuitry of a PLD such as an FPGA device having configuration memory cells powered by the same voltage supply as the I/O circuitry. Of course, embodiments of the present invention are equally applicable to other configurable devices (e.g., complex PLDs) and to other non-configurable devices (e.g., application-specific integrated circuits). In the following description, for purposes of explanation, specific nomenclature is set forth to provide a thorough understanding of the present invention. In other instances, well-known circuits and devices are shown in block diagram form to avoid obscuring the present invention. Further, the logic levels assigned to various signals in the description below are arbitrary and, thus can be modified (e.g., reversed polarity) as desired. Accordingly, the present invention is not to be construed as limited to specific examples described herein but rather includes within its scope all embodiments defined by the appended claims.

Figure 2:
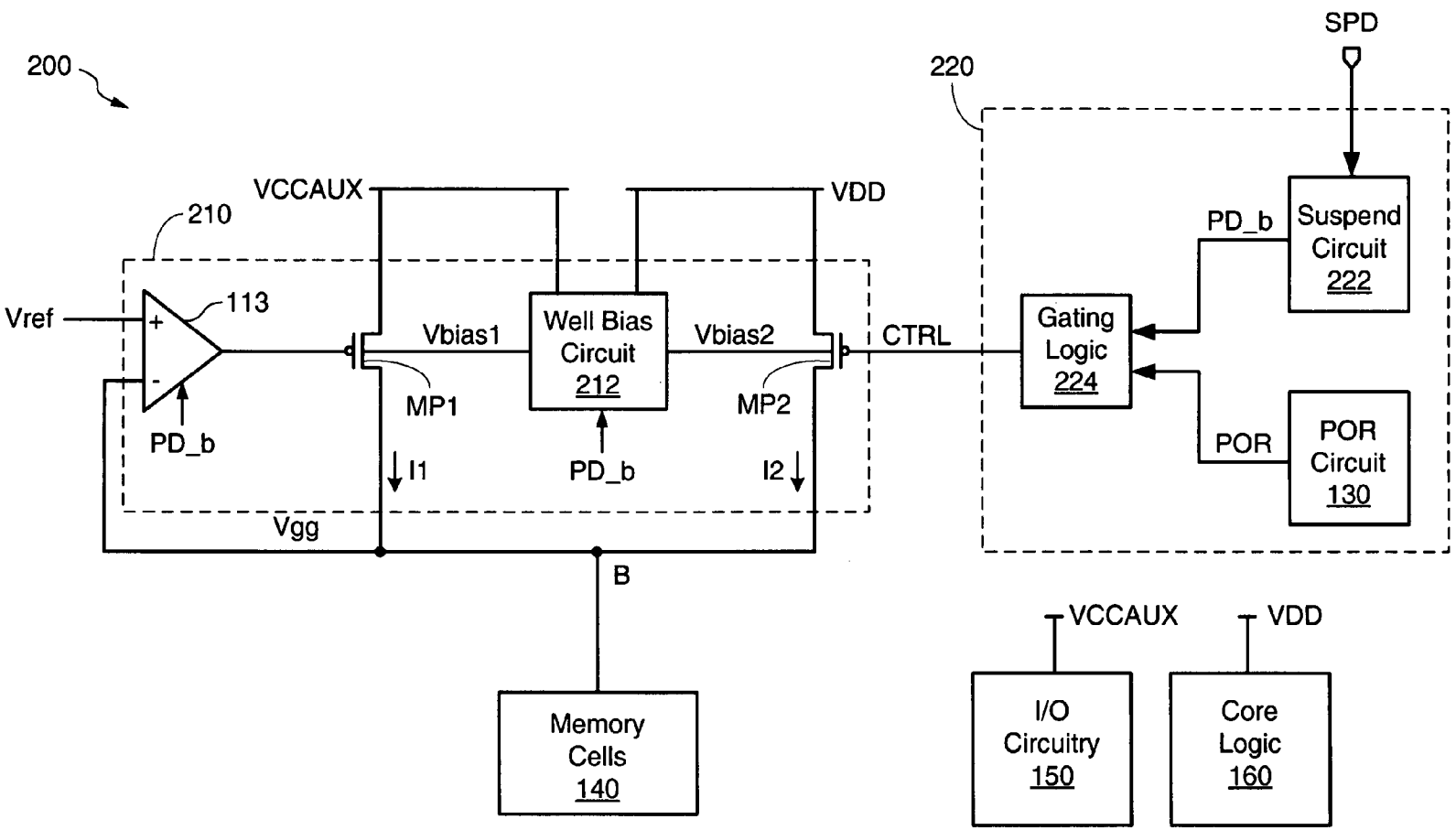
FIG. 2 is a simplified block diagram of a portion an IC device having a voltage regulation circuit configured in accordance with some embodiments of the present invention.

FIG. 2 shows a portion of an integrated circuit (IC) device 200 having a voltage regulation circuit configured in accordance with the present invention. Device 200 may be any suitable IC device including, for example, configurable logic devices such as PLDs and non-configurable devices such as ASIC devices. For some embodiments, device 200 is an FPGA device. Device 200 is shown in FIG. 2 to include a plurality of memory cells 140, I/O circuitry 150, core logic 160, a voltage regulation circuit 210, and a mode control circuit 220. For exemplary embodiments described herein, memory cells 140 may be any suitable volatile memory cells such as DRAM or SRAM cells, and may be organized in any suitable memory array architecture. For other embodiments, memory cells 140 may be non-volatile memory cells such as EPROM, EEPROM, and/or flash memory cells. I/O circuitry 150, which may be formed using well-known circuit elements and/or architectures, has a power terminal coupled to VCCAUX. Core logic 160, which may include any well-known logic elements, has a power terminal coupled to VDD. For some embodiments in which device 200 is an FPGA device, memory cells 140 may store configuration data for the FPGA device, I/O circuitry 150 may include the IOBs of the FPGA device, and core logic 160 may include various configurable logic elements (e.g., CLBs) of the FPGA device. For simplicity, the interconnections between memory cells 140, I/O circuitry 150, and core logic 160 are not shown in FIG. 2. Further, although not shown in FIG. 2 for simplicity, memory cells 140, I/O circuitry 150, and core logic 160 may also have power terminals coupled to ground potential.

As shown in FIG. 2, device 200 is powered by a main voltage supply VDD and an auxiliary voltage supply VCCAUX. For some embodiments, VCCAUX and VDD are externally generated voltage supplies provided to device 200 via corresponding I/O pins (not shown for simplicity). For other embodiments, VCCAUX and VDD may be generated on chip. For exemplary embodiments described herein, VCCAUX has a value ranging from between approximately 2 and 4 volts, VDD has a value equal to approximately 1.2 volts, and Vgg is regulated to approximately 1.4 volts. Of course, for actual embodiments, VCCAUX, VDD, and Vgg may be other suitable voltages.

Voltage regulator circuit 210, which includes op-amp 113, PMOS transistors MP1-MP2, and a well bias circuit 212, generates a regulated voltage Vgg at power node B, where Vgg serves as a voltage supply for memory cells 140 during operation of device 200. PMOS transistor MP1 is coupled between VCCAUX and node B, and has a gate coupled to the output of op-amp 113. Op-amp 113, which is well-known, includes a first input terminal coupled to Vref, and includes a second input terminal coupled to node B. Op-amp 113 controls the current flow 11 through transistor MP1 in response to the voltage differential between Vref and Vgg to regulate Vgg to a value approximately equal to Vref. The reference voltage Vref may be generated using any well-known technique, for example, using a ratioed bandgap reference voltage circuit. For the exemplary embodiments described herein, Vref is approximately 1.4 volts, although for actual embodiments Vref may be other suitable voltages. PMOS transistor MP2 is coupled between VDD and node B, and has a gate to receive a control signal CTRL from mode control circuit 220, where CTRL controls the current flow 12 through transistor MP2.

PMOS transistors MP1-MP2 are well-known power transistors that have thick gate oxides and relatively large channel widths, for example, so that transistors MP1-MP2 are relatively insusceptible to voltage breakdown and can handle relatively large currents for generating Vgg. PMOS transistor MP1 is formed in a first n-well region that receives a first bias voltage Vbias1 from well bias circuit 212. PMOS transistor MP2 is formed in a second n-well region that receives a second bias voltage Vbias2 from well bias circuit 212. Well bias circuit 212 includes a first power terminal coupled to VCCAUX, a second power terminal coupled to VDD, and an input to receive an active-low power-down signal PD_b. As explained in more detail below, well bias circuit 212 selectively adjusts the well bias voltages Vbias1 and Vbias2 to prevent the corresponding well/source junction diodes of transistors MP1 and MP2, respectively, from becoming forward biased during operation of device 200.

Mode control circuit 220 includes POR circuit 130, a suspend circuit 222, and gating logic 224. Gating logic 224, which may be any suitable combinational logic circuit, has a first input coupled to an output of POR circuit 130, a second input coupled to an output of suspend circuit 222, and an output coupled to the gate of PMOS transistor MP2. POR circuit 130, which is well-known, informs device 200 when to start configuration and/or to reset its registers. For example, upon power-up of device 200, POR circuit 130 initially de-asserts POR to logic low. Then, when VDD has reached some predetermined level (e.g., suitable for initializing core logic 160 to an operational state), POR circuit 130 asserts POR to logic high, which informs device 200 that normal operation may begin.

Suspend circuit 222 includes an input to receive a suspend signal SPD, and in response thereto generates PD_b. For some embodiments, the suspend signal SPD is an externally generated signal (e.g., a user-generated signal) that may be provided to device 200 via a corresponding I/O pin (not shown for simplicity). As explained in more detail below, suspend circuit 222 may be used to initiate a suspend operation that disables VCCAUX to minimize power consumption of circuit elements such as I/O circuitry 150 that are powered by VCCAUX.

Figure 3:
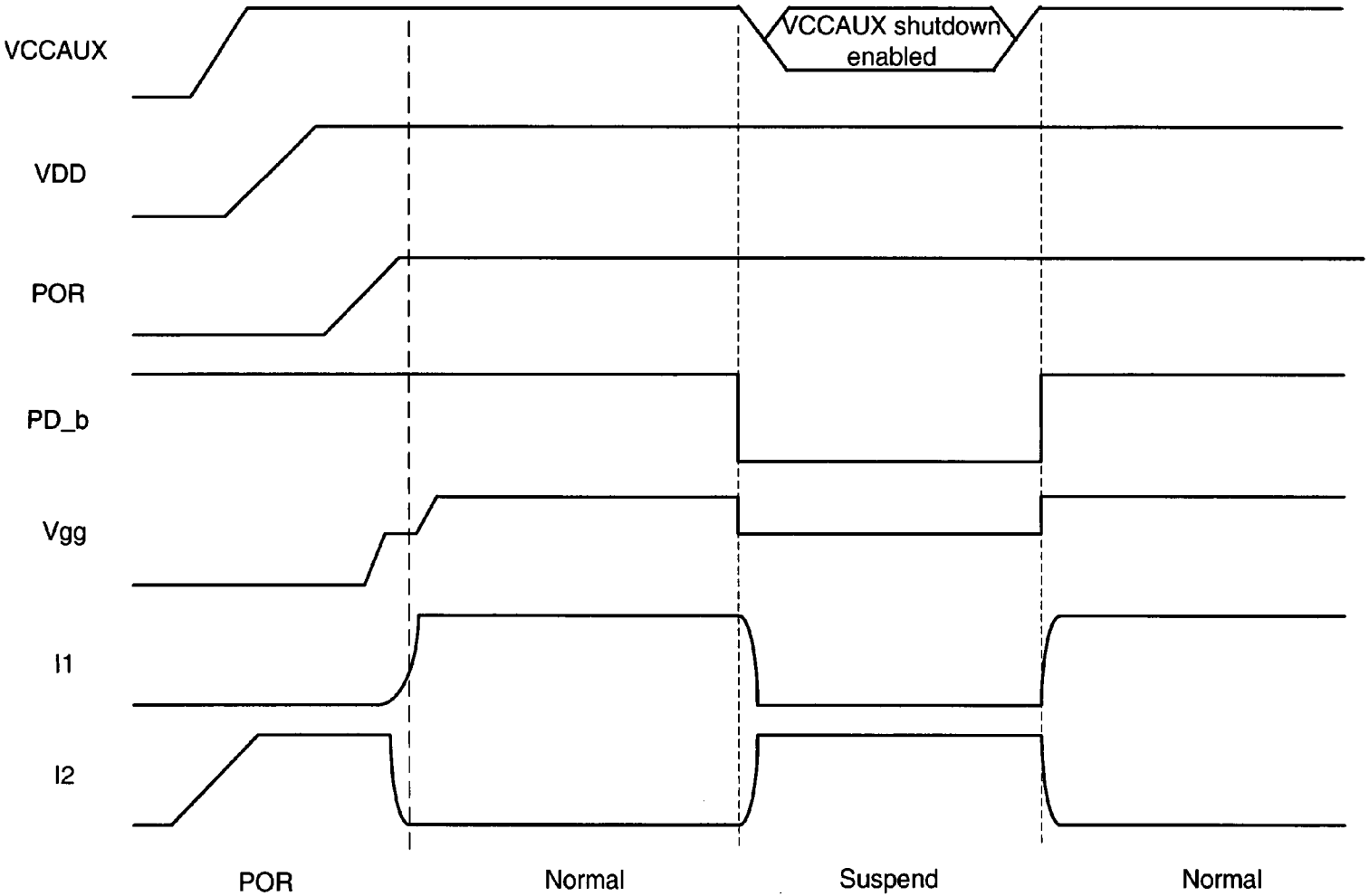
FIG. 3 is an illustrative waveform diagram depicting an exemplary operation of one embodiment of the voltage regulation circuit of FIG. 2.

An exemplary operation of one embodiment of device 200 of FIG. 2 is described below with respect to the illustrative waveform diagram of FIG. 3. When device 200 is first powered-up (e.g., during POR mode), POR circuit 130 initializes POR to logic low, suspend circuit 222 initializes PD_b to a de-asserted logic high state, and the voltage levels of VCCAUX and VDD begin to increase toward their nominal values. In response to the logic high state of PD_b, gating circuit 224 passes the POR signal as a control signal CTRL to the gate of transistor MP2, which in response thereto turns on and begins conducting a current I2 from VDD to node B. The current I2 quickly increases and charges Vgg towards VDD, thereby initializing memory cells 140 to operational states prior to normal operation of device 200. Note that during the POR mode, op-amp 113 is not operational, and the current I1 through transistor MP1 is negligible, as depicted in FIG. 3.

When VDD has reached an acceptable level, POR circuit 130 asserts POR to logic high and allows device 200 to enter its normal mode of operation. For some embodiments, POR circuit 130 causes the voltage level of POR to gradually increase at a rate similar to the charging rate of VDD, for example, as depicted in FIG. 3. With PD_b still in its de-asserted logic high state, gating circuit 224 passes the logic high state of POR as a logic high control signal CTRL to the gate of transistor MP2, thereby turning off transistor MP2 and isolating VDD from Vgg.

As known in the art, assertion of POR (e.g., to logic high) informs device 200 that circuit elements such as core logic 160 that are powered by VDD may be initialized to operational states, and may also initialize circuitry that delivers VCCAUX to corresponding circuit elements such as I/O circuitry 150. More specifically, assertion of POR enables op-amp 113 and associated voltage regulation circuitry (not shown for simplicity) to generate a regulated voltage Vgg at power node B by turning on PMOS transistor MP1. As depicted in FIG. 3, when op-amp 113 turns on transistor MP1, the current I1 from VCCAUX to node B through transistor MP1 quickly increases and charges Vgg to Vref, which for exemplary embodiments described herein is greater than VDD. Thereafter, op-amp 113 may regulate Vgg to Vref in a well-known manner by adjusting the gate voltage of transistor MP1. Note that during normal operation, the current I2 through transistor MP2 is negligible, as depicted in FIG. 3.

As mentioned above, during normal operation of device 200, suspend circuit 222 de-asserts PD_b to logic high. In accordance with the present invention, the logic high state of PD_b causes well bias circuit 212 to couple the n-well region of PMOS transistor MP2 to Vgg (i.e., Vbias2=Vgg). In this manner, if undesirable fluctuations in VDD and/or Vgg cause Vgg to become significantly greater than VDD, biasing the well of transistor MP2 with Vgg prevents the well/source junction diode of transistor MP2 from becoming forward biased (e.g., because the well of MP2 is at a higher potential than the source of MP2), thereby preventing an undesirable current path from VCCAUX to VDD through transistor MP2 during normal operation of device 200. Further, during normal operation, well bias circuit 212 couples the n-well region of PMOS transistor MP1 to VCCAUX. Because VCCAUX is greater than Vgg, biasing the well region of transistor MP1 to VCCAUX during the normal mode prevents leakage currents in transistor MP1.

In accordance with the present invention, a user may assert SPD to logic high to initiate a suspend mode for device 200 that disables VCCAUX to minimize power consumption of circuit elements such as I/O circuitry 150 that are powered by VCCAUX, for example, when device 200 is not communicating with other devices, while maintaining power to circuit elements such as core logic 160 that are powered by VDD. For some embodiments, when SPD is asserted to logic high, suspend circuit 222 asserts PD_b to logic low. The asserted logic low state of PD_b disables power circuitry (not shown for simplicity) associated with VCCAUX so that circuitry such as I/O circuitry 150 that is powered by VCCAUX is powered down to minimize power consumption during the suspend mode. For some embodiments, assertion of PD_b may force op-amp 113 to a disabled state that reduces current flow I1 through transistor MP1 to a negligible level, as depicted in FIG. 3, so that Vgg is no longer charged by VCCAUX (which is not available during the suspend mode). Also, during suspend mode, assertion of PD_b may be used to disable circuitry that generates Vref, as well as disabling op-amp 113, to further reduce power consumption.

The logic low state of PD_b also causes gating logic 224 to drive CTRL to a logic low state, thereby turning on transistor MP2 to provide a quickly increasing current I2 that charges Vgg toward VDD. As depicted in FIG. 3, generating Vgg from VDD instead of from VCCAUX during suspend mode may cause the value of Vgg to fall slightly, which further reduces power consumption by reducing leakage currents in memory cells 140. However, in accordance with the present invention, the voltage level of Vgg during suspend mode is sufficient to prevent loss of data stored in memory cells 140. The logic low state of PD_b also causes well bias circuit 212 to couple the well region of transistor MP2 to VDD (e.g., instead of to Vgg), which is desirable because VDD is typically greater than Vgg during suspend mode.

The ability to disable VCCAUX during suspend mode to reduce power consumption without losing data stored in memory cells 140 is advantageous. For example, for embodiments in which device 200 is an FPGA device, I/O circuitry 150 may be powered down during a user-initiated suspend mode to reduce power consumption of the FPGA when the FPGA is not communicating with other devices without losing configuration data stored in configuration memory cells 140. In this manner, when the FPGA device returns to a normal operational mode, the FPGA device does not have to be re-configured, thereby saving time.

Further, in accordance with the present invention, during suspend mode, well bias circuit 212 may adjust the well bias voltage Vbias1 for transistor MP1 to prevent an undesirable current path between VDD and VCCAUX. For example, when VCCAUX is not available to bias the well region of transistor MP1, well bias circuit 212 couples the well of transistor MP1 to Vgg, thereby preventing the well/source junction diode of transistor MP1 from becoming forward biased.

Figure 4:
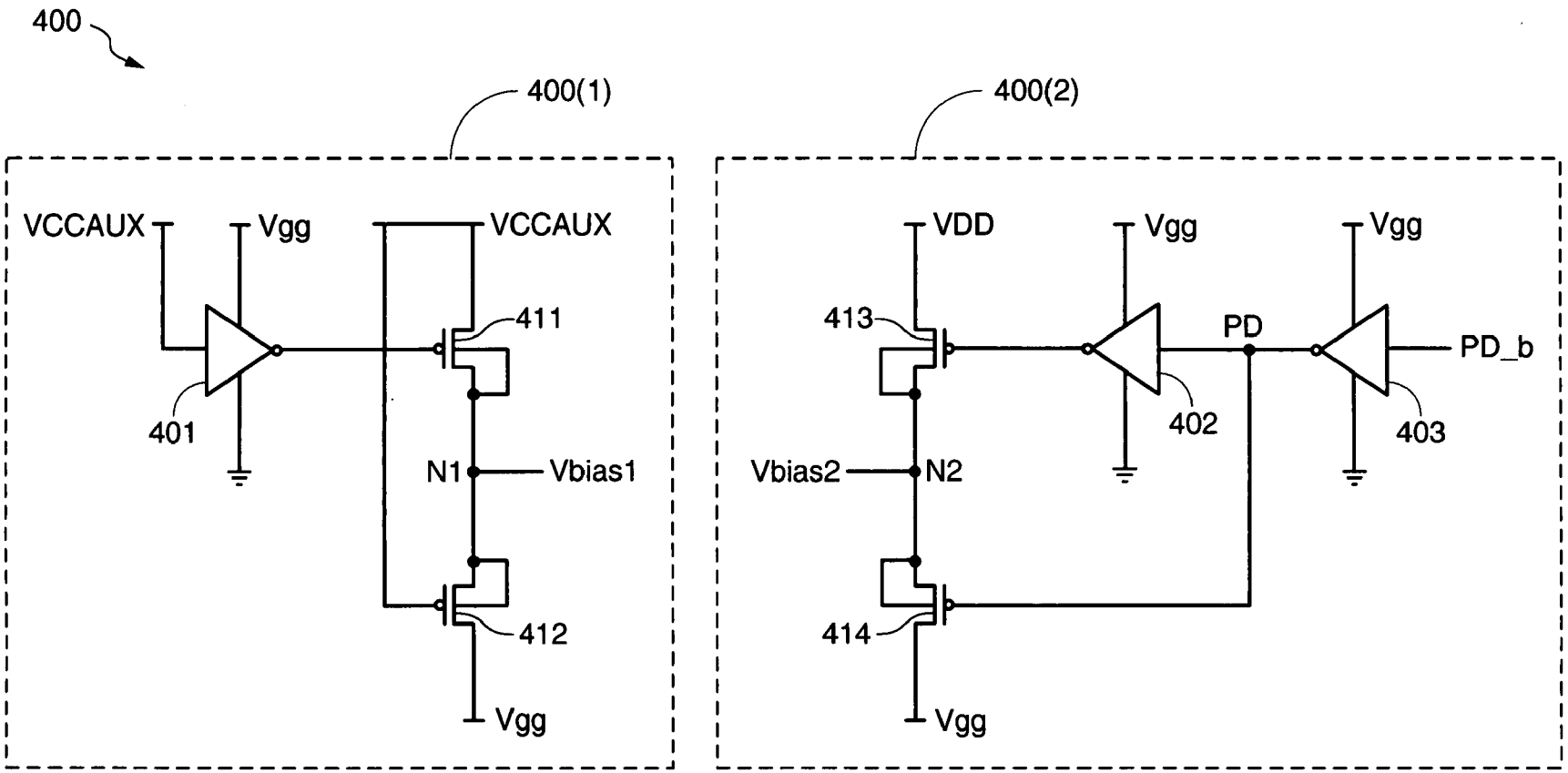
FIG. 4 is a simplified circuit diagram of one embodiment of the well bias circuit of FIG. 2.

FIG. 4 shows a well bias circuit 400 that is one embodiment of well bias circuit 212 of FIG. 2. Well bias circuit 400 has a first portion 400(1) configured to selectively adjust Vbias1 for transistor MP1's well region during operation of device 200, and includes a second portion 400(2) configured to selectively adjust Vbias2 for transistor MP2's well region during operation of device 200. First portion 400(1) includes an inverter 401 and PMOS transistors 411-412. PMOS transistors 411-412 are connected in series between VCCAUX and Vgg, and together generate Vbias1 at node N1. The gate of transistor 411 is coupled to the output of inverter 401, which includes an input coupled to VCCAUX, a first power terminal coupled to Vgg, and a second power terminal coupled to ground potential. The gate of transistor 412 is coupled to VCCAUX. The well regions of transistors 411-412 are coupled together to Vbias1. For some embodiments, PMOS transistors 411-412 may have relatively thick gate oxide layers to prevent voltage breakdown when handling voltage supplies such as VCCAUX.

Second portion 400(2) includes inverters 402-403 and PMOS transistors 413-414. PMOS transistors 413-414 are connected in series between VDD and Vgg, and together generate Vbias2 at node N2. The gate of transistor 413 is coupled to the output of inverter 402, which includes a first power terminal coupled to Vgg, a second power terminal coupled to ground potential, and an input coupled to the output of inverter 403. Inverter 403 includes a first power terminal coupled to Vgg, a second power terminal coupled to ground potential, and an input to receive PD_b. The gate of transistor 414 is coupled to the output of inverter 403. The well regions of transistors 413-414 are coupled together to Vbias2.

An exemplary operation of circuit 400 of FIG. 4 is as follows. Referring also to FIG. 2, during normal mode, PD_b is driven to logic high, which is logically inverted by inverter 403 to drive PD to a logic low state. The logic low state of PD is logically inverted by inverter 402 to drive the gate of PMOS transistor 413 to a logic high state approximately equal to Vgg. In response thereto, transistor 413 turns off and isolates Vbias2 at node N2 from VDD. The logic low state of PD also turns on transistor 414, which pulls Vbias2 to Vgg. As explained above, biasing transistor MP2's n-well region to Vgg instead of VDD during normal mode prevents the well/source junction diode within transistor MP2 from becoming forward biased when Vgg significantly exceeds VDD. Further, note that driving the gate of transistor 413 with Vgg instead of VDD ensures that transistor 413 remains in a non-conductive state even when Vgg is significantly greater than VDD, thereby preventing a current path from VDD to Vgg through transistor 413.

During suspend mode, PD_b is driven to logic low, which is logically inverted by inverter 403 to drive PD to a logic high state of approximately Vgg. The logic high state of PD turns off transistor 414, which isolates Vbias2 from Vgg. Note that driving the gate of transistor 414 with Vgg instead of VDD ensures that transistor 414 remains in a non-conductive state even when Vgg is significantly greater than VDD, thereby preventing a current path from VDD to Vgg through transistor 414. The logic high state of PD is logically inverted by inverter 402 to drive the gate of PMOS transistor 413 to a logic low state (e.g., ground potential). In response thereto, transistor 413 turns on and pulls Vbias2 towards VDD.

During both normal and suspend modes, the first portion 400(1) of well bias circuit 400(0) selectively couples the n-well of PMOS transistor MP1 to either VCCAUX or to Vgg. For example, during normal operation when VCCAUX is available as a voltage supply to circuit 400 and is near its intended value, VCCAUX appears as a logic high signal at the input of inverter 401 and at the gate of PMOS transistor 412. In response thereto, transistor 412 turns off and isolates Vbias1 from Vgg. Inverter 401 logically inverts the logic high signal at its input to drive the gate of PMOS transistor 411 to a logic low state (e.g., ground potential). In response thereto, transistor 411 turns on and pulls Vbias1 to VCCAUX.

Conversely, if VCCAUX is not available, for example, during suspend mode, well bias circuit 400 couples transistor MP1's well region to Vgg instead of VCCAUX. For example, if the voltage level of VCCAUX falls to a value indicative of a logic low state, inverter 401 drives the gate of PMOS transistor 411 to logic high (e.g., to Vgg), thereby turning off transistor 411 and isolating Vbias1 from VCCAUX. The logic low state of VCCAUX turns on transistor 412, which pulls Vbias1 to Vgg.

Figure 1A:
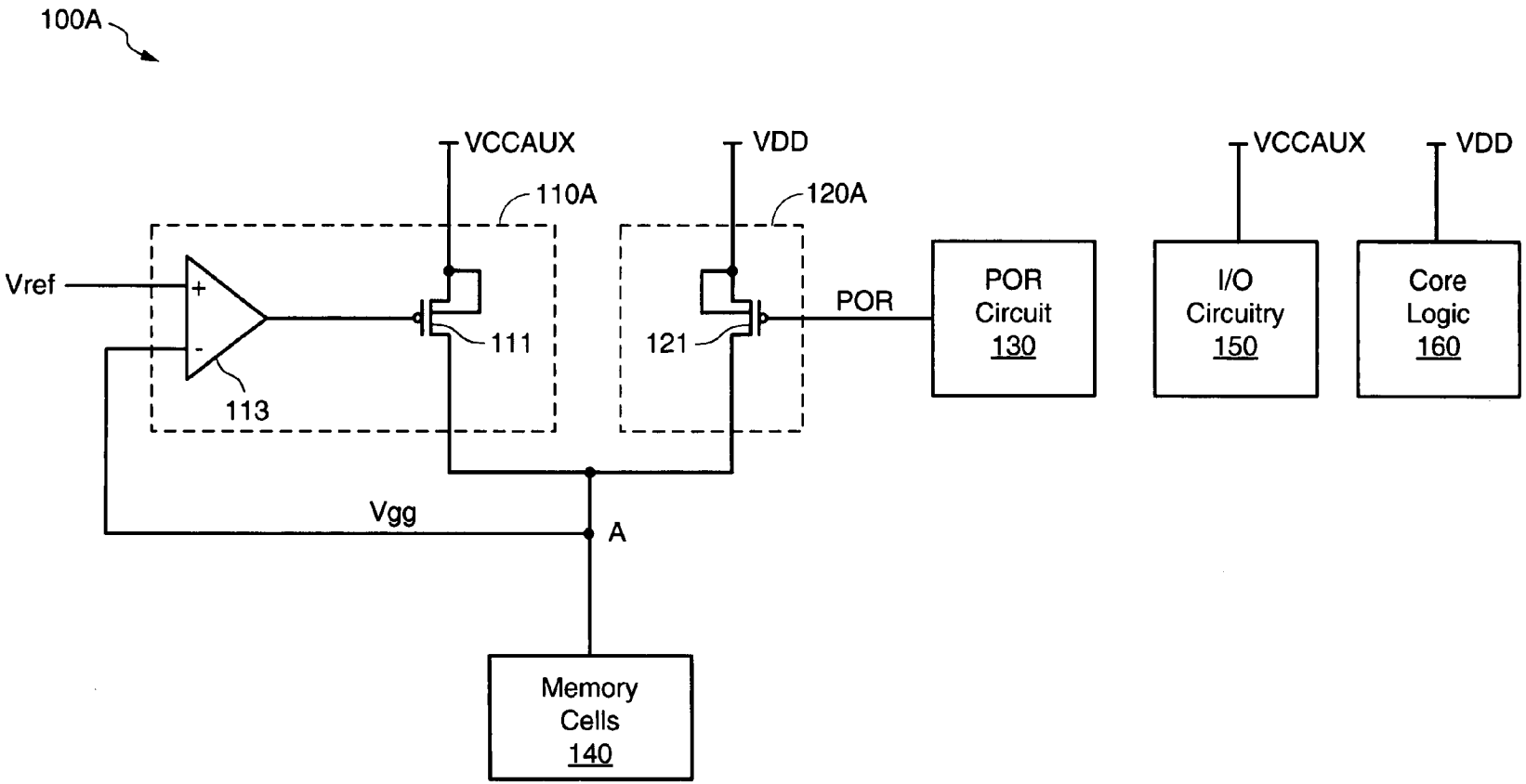
FIG. 1A (Prior Art)
FIG. 1A is a simplified block diagram of a portion of an IC device having a conventional voltage regulation circuit.
Figure 1B:
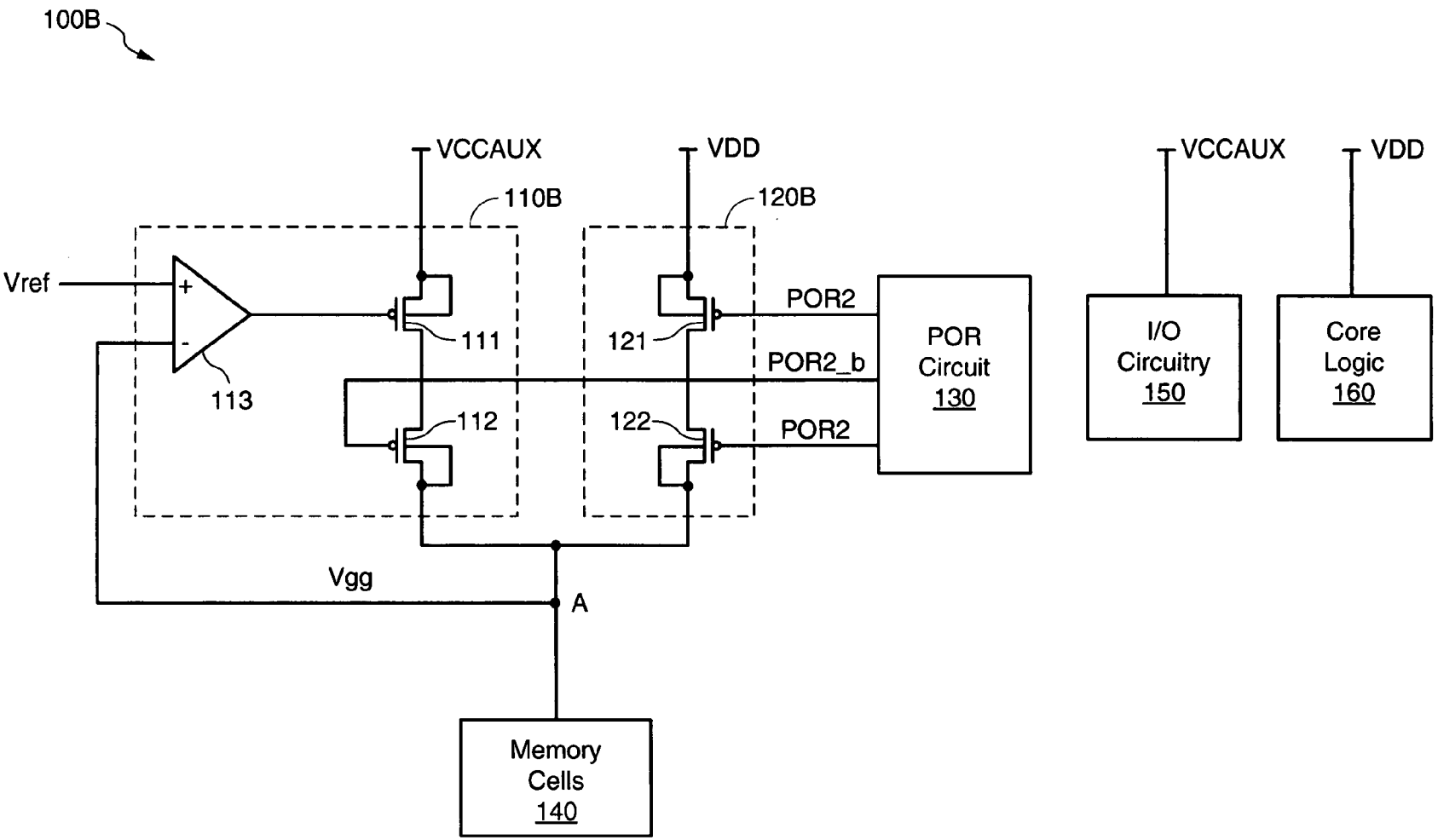
FIG. 1B (Prior Art)
FIG. 1B is a simplified block diagram of a portion of an IC device having another conventional voltage regulation circuit.

In addition to allowing VCCAUX to be disabled to reduce power consumption in I/O circuitry 150 without losing data stored in memory cells 140 that are normally powered by VCCAUX, embodiments of the present invention are able to prevent the forward biasing of the well/source junction diodes within PMOS transistors MP1 and MP2 of device 200 of FIG. 2 when Vgg significantly exceeds VDD using less circuit area than the prior art circuit of FIG. 1B. For example, while the power regulation scheme utilized in device 100B of FIG. 1B requires four power transistors 111-112 and 121-122, embodiments of the present invention illustrated, for example, in FIG. 2 require only two power transistors MP1-MP2, where each of power transistors MP1-MP2 may be approximately one-half the size of transistors 111-112 and 121-122 of FIG. 1B while providing similar drive strength for generating Vgg.

Figure 5:
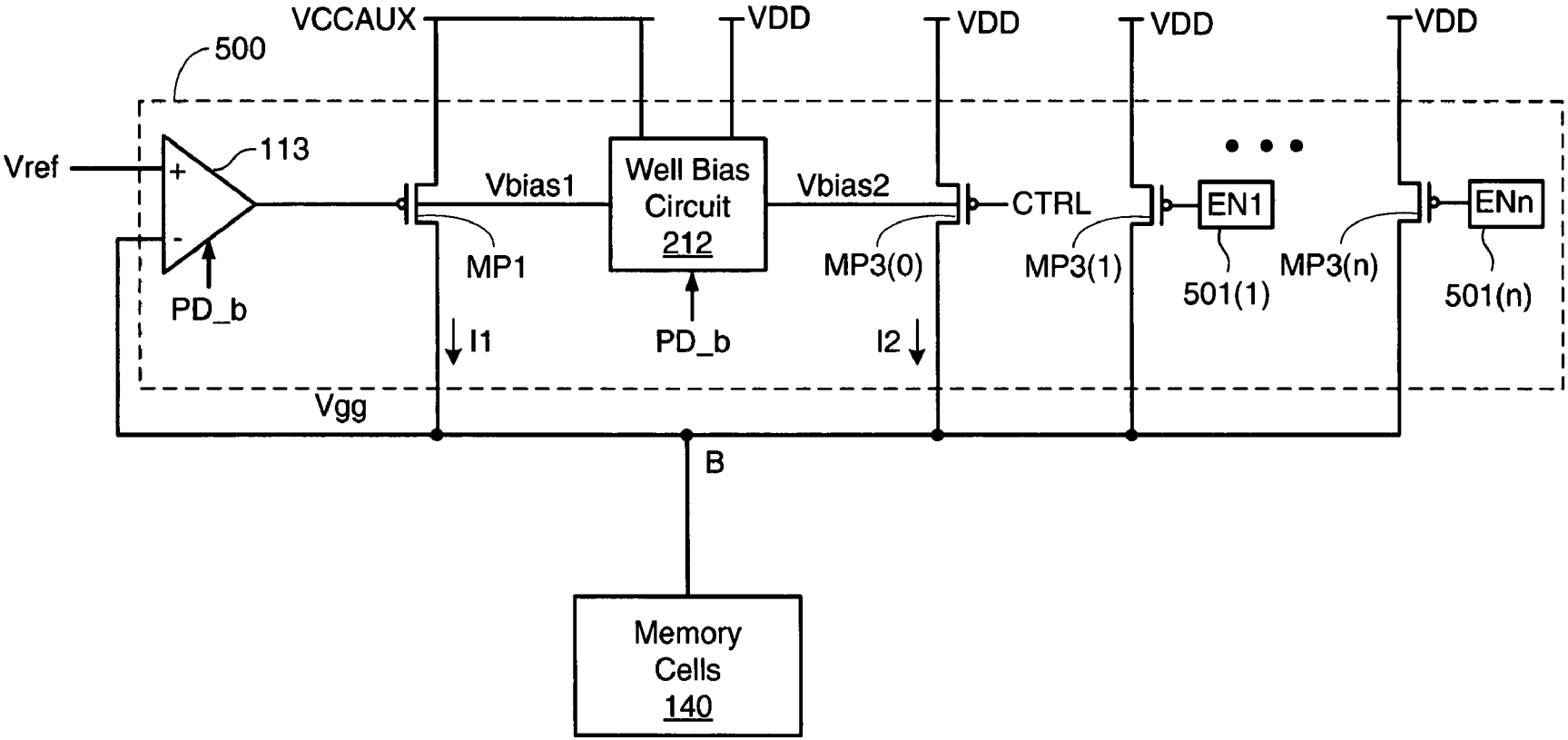
FIG. 5 is simplified block diagram of a voltage regulation circuit in accordance with another embodiment of the present invention.

Referring again to FIG. 2, for other embodiments, PMOS transistor MP2 may be replaced by a plurality of smaller PMOS transistors connected in parallel with each other between VDD and node B, where one or more of the PMOS transistors may be selectively enabled during the suspend mode to adjust the value of Vgg generated from VDD during the suspend mode. For example, FIG. 5 shows a voltage regulation circuit 500 that is an alternate embodiment of the voltage regulation circuit 210 of FIG. 2. Voltage regulation circuit 500 of FIG. 5 is similar to voltage regulation circuit 210 of FIG. 2, except that PMOS transistor MP2 is replaced by a plurality of PMOS transistors MP3(0)-MP3(*n*), each coupled between VDD and power node B. The gate of transistor MP3(0) is responsive to CTRL (e.g., generated by mode control circuit 220 of FIG. 2), has an n-well coupled to receive Vbias2 from well bias circuit 212, and operates in a manner similar to that described above with respect to transistor MP2 of FIG. 2. The gate of each of transistors MP3(1)-MP3(*n*) receives a corresponding enable signal EN1-ENn stored in storage elements 501(1)-501(*n*), respectively. Storage elements may be any suitable storage device such as, for example, SRAM cells, DRAM cells, registers, PROM cells, EPROM cells, EEPROM cell, flash memory cells, fuses, and the like. For other embodiments, the enable signals EN1-ENn may be hardwired to either a logic high state (e.g., VDD) or to a logic low state (e.g., ground potential) to achieve a desired value of Vgg during suspend mode.

During suspend mode, the value of Vgg may be adjusted by enabling various numbers of PMOS transistors MP3(1)-MP3(*n*) to conduct current in parallel with transistor MP3(0) from VDD to node B. For example, for some applications, the enable signals EN1-ENn may all be asserted to logic low during suspend mode to turn on all corresponding transistors MP3(1)-MP3(*n*), thereby maximizing the value of Vgg by minimizing the transistor on-resistance between VDD and node B. Conversely, for other applications, the enable signals EN1-ENn may all be de-asserted to logic high during suspend mode to turn off all corresponding transistors MP3(1)-MP3(*n*), thereby minimizing the value of Vgg by maximizing the transistor on-resistance between VDD and node B. The ability to adjust the value of Vgg during suspend mode by selectively enabling transistors MP3(1)-MP3(*n*) is advantageous. For example, the integrity of data stored in memory cells 140 may be improved by increasing the value of Vgg at node B, and power dissipation resulting from leakage currents in memory cells 140 may be minimized by reducing the value of Vgg at node B. Because the leakage current is exponentially related to Vgg, reducing Vgg by a few tenths of a volts may result in a significant reduction in power dissipation associated with such leakage currents.

While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention. For example, although some exemplary embodiments are described above as utilizing PMOS transistors, for other embodiments, NMOS transistors may be used to generate Vgg from VDD and/or VCCAUX.

What is claimed is:

1. A voltage regulator circuit for providing power to a power node of an integrated circuit device, comprising:

a first transistor coupled between a first voltage supply and the power node, and having a gate responsive to a regulation signal;

a second transistor coupled between a second voltage supply and the power node, and having a gate responsive to a power-down signal; and a well bias circuit having an input coupled to receive the power-down signal, having a first output coupled to a well region of the first transistor, and having a second output coupled to a well region of the second transistor.

2. The voltage regulator circuit of claim 1, wherein the well bias circuit selectively adjusts a first bias voltage provided to the well of the first transistor and selectively adjusts a second bias voltage provided to the well of the second transistor.

3. The voltage regulator circuit of claim 1, wherein the well bias circuit selectively couples the well of the first transistor to either the first voltage supply or to the power node in response to a magnitude of the first voltage supply.

4. The voltage regulator circuit of claim 1, wherein the well bias circuit selectively couples the well of the second transistor to either the second voltage supply or to the power node in response to the power-down signal.

5. The voltage regulator circuit of claim 1, wherein the power-down signal is generated by a suspend circuit in response to an externally-generated suspend signal.

6. The voltage regulator circuit of claim 1, wherein during a normal mode, the power-down signal is de-asserted, the de-asserted power-down signal turning off the second transistor to isolate the second voltage supply from the power node and causing the well bias circuit to couple the well of the second transistor to the power node.

7. The voltage regulator circuit of claim 6, wherein during a suspend mode, the power-down signal is asserted, the asserted power-down signal turning on the second transistor to couple the second voltage supply to the power node and causing the well bias circuit to couple the well of the second transistor to the second voltage supply.

8. The voltage regulator circuit of claim 7, wherein during the suspend mode, the asserted power-down signal disables the first voltage supply.

9. The voltage regulator circuit of claim 1, further comprising:

a plurality of third transistors, each coupled in parallel between the second voltage supply and the power node and each having a gate to receive a corresponding enable signal.

10. The voltage regulator circuit of claim 9, wherein a magnitude of a voltage produced at the power node may be adjusted by selectively asserting one or more of the enable signals to turn on one or more corresponding third transistors.

11. The voltage regulator circuit of claim 9, wherein the enable signals are stored in one or more storage elements.

12. An integrated circuit (IC) device, comprising:

a first voltage supply for powering first circuitry within the device;

a second voltage supply for powering second circuitry within the device, wherein the second voltage supply is less than the first voltage supply;

a suspend circuit having an output to generate a power-down signal; and a voltage regulator circuit coupled to a power node, the voltage regulator circuit comprising:

a first transistor coupled between the first voltage supply and the power node, and having a gate responsive to a regulation signal;

a second transistor coupled between the second voltage supply and the power node, and having a gate responsive to the power-down signal; and a well bias circuit having an input coupled to receive the power-down signal, a first output coupled to a well region of the first transistor, and a second output coupled to a well region of the second transistor.

13. The IC device of claim 12, wherein the well bias circuit selectively adjusts a first bias voltage provided to the well of the first transistor and selectively adjusts a second bias voltage provided to the well of the second transistor.

14. The IC device of claim 12, wherein during a normal mode, the first transistor generates a regulated voltage at the power node from the first voltage supply and the suspend circuit de-asserts the power-down signal, the de-asserted power-down signal turning off the second transistor to isolate the second voltage supply from the power node and causing the well bias circuit to couple the well of the second transistor to the power node.

15. The IC device of claim 14, wherein during a suspend mode, the suspend circuit asserts the power-down signal, the asserted power-down signal turning on the second transistor to generate a voltage at the power node from the second voltage supply and causing the well bias circuit to couple the well of the second transistor to the second voltage supply.

16. The IC device of claim 15, wherein during the suspend mode, the asserted power-down signal disables the first voltage supply to power-down the first circuitry.

17. The IC device of claim 16, further comprising a plurality of volatile memory cells coupled to the power node, wherein during the normal mode the memory cells are powered from the first voltage supply via the first transistor and during the suspend mode the memory cells are powered from the second voltage supply via the second transistor.

18. The IC device of claim 12, further comprising:

a plurality of third transistors, each coupled in parallel between the second voltage supply and the power node and each having a gate to receive a corresponding enable signal.

19. The IC device of claim 12, wherein during a suspend mode, the suspend circuit asserts the power-down signal to turn on the second transistor to generate a voltage at the power node from the second voltage supply and to disable the first transistor, wherein during the suspend mode a magnitude of the voltage produced at the power node may be adjusted by selectively asserting one or more of the enable signals to turn on one or more corresponding third transistors.

20. The IC device of claim 12, wherein the enable signals are stored in one or more storage elements.

* * * * *